US006454436B1

(12) United States Patent
Ilyes et al.

(10) Patent No.: US 6,454,436 B1
(45) Date of Patent: Sep. 24, 2002

(54) LAMP SECURING DEVICE

(75) Inventors: Laszlo S. Ilyes, Richmond Heights; Robert S. McFeely, Valley View, both of OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/749,614

(22) Filed: Dec. 27, 2000

(51) Int. Cl.[7] ..... H01J 5/48

(52) U.S. Cl. ..... 362/226; 313/318.09; 313/318.1; 315/58; 362/265

(58) Field of Search ..... 362/226, 265, 362/365, 378; 315/56, 58, 61; 313/318.01, 318.05, 318.09, 318.1, 318.11, 318.12

(56) References Cited

U.S. PATENT DOCUMENTS 4,093,893 A * 6/1978 Anderson ..... 315/48
4,443,778 A * 4/1984 Mewissen ..... 336/90
4,623,823 A * 11/1986 Engel ..... 315/58
5,189,339 A * 2/1993 Peshak ..... 315/58
5,304,076 A * 4/1994 Pelton ..... 439/683

FOREIGN PATENT DOCUMENTS

WO WO 99/12187 3/1999

* cited by examiner

*Primary Examiner*—Sandra O'Shea
*Assistant Examiner*—Hargobind S. Sawhney
(74) *Attorney, Agent, or Firm*—Fay, Sharpe, Fagan, Minnich & McKee, LLP

(57) ABSTRACT

A lamp securing device for securing a lamp (120) to a housing (110) including a retainer (130) including a peripheral portion that bounds an opening (300) of sufficient size for receiving a neck (170) of the lamp (120). The retainer (130) includes a plurality of flanges (310, 320) along the opening (300) which engage the neck (170) of the lamp (120) to securely attach the retainer (130) to the lamp (120).

17 Claims, 2 Drawing Sheets

LAMP SECURING DEVICE

BACKGROUND OF THE INVENTION

1. Field of the Invention

This application relates to a securing device, and in particular, to a retaining device for a lighting system in which the lamp and electronics are integrally connected.

2. Discussion of the Art

Some lamps require a voltage. lower than the main, or line, voltage to which the lamps are connected because of the voltage rating of the lamp filaments. For example, typical line voltage is about 120 V, but certain lamp filaments, such as those found in MR16 lamps, are only approximately 12 V. These lamps are particularly desirable in a variety of applications because of their higher quality optics. However, in order for these lamps to be used, the line voltage must be stepped-down.

One known approach for stepping-down voltage is to connect the lamps to light fixtures which incorporate electronic power converters or transformers. Such converters add both hardware and expense to the light fixtures. Further, many of these lamps are used in the retail industry where it is less desirable to have separate electronic converter boxes in plain view of the customers for aesthetic reasons.

Another prior art approach is to place the electronic power converter within the outer or lamp housing, i.e., the lamp and electronics are self-contained in one structure. Thus, the electronic converters are integrally connected to the lamps, making external electronic converters unnecessary. This lighting system or integral lamp approach requires that the lamp be secured to the outer housing so that it does not become disconnected from either the outer housing or the electronic power converter. Known lighting systems use custom lamp assemblies to prevent disassociation. These assemblies increase costs since commercially available lamps are not used in the manufacturing of the lighting systems.

Accordingly, a need exists for a less expensive lighting system that utilizes existing lamps.

BRIEF SUMMARY OF THE INVENTION

The present invention provides an inexpensive retaining device for securing a commercially available lamp to an outer housing which also contains an electronic converter. No custom lamp assembly is needed.

An exemplary embodiment of the invention concerns a lamp securing device for securing a lamp to a housing. A retainer includes a peripheral portion that bounds an opening of sufficient size for receiving a neck of the lamp. The retainer includes a plurality of flanges along the opening which engage the neck of the lamp to securely attach the retainer to the lamp.

Practice of the invention results in a lighting system which includes a housing having an interior space, a base fixed to the housing, a lamp within the housing, an electronic circuit supported within the housing, and a retainer securely attached to the lamp. The lamp has a neck. The electronic power converter circuit is connected to the lamp. The retainer secures the lamp to the housing.

The lighting system has a number of advantages over the prior art. Existing lamps may be utilized in manufacturing integral lamp assemblies, reducing manufacturing changeover costs.

Another advantage with the lighting system resides in the fact that the assembly of the lighting system is simpler and may be accomplished in a modular way.

DETAILED DESCRIPTION OF THE PREFERRED EMBODIMENT

Figure 1:
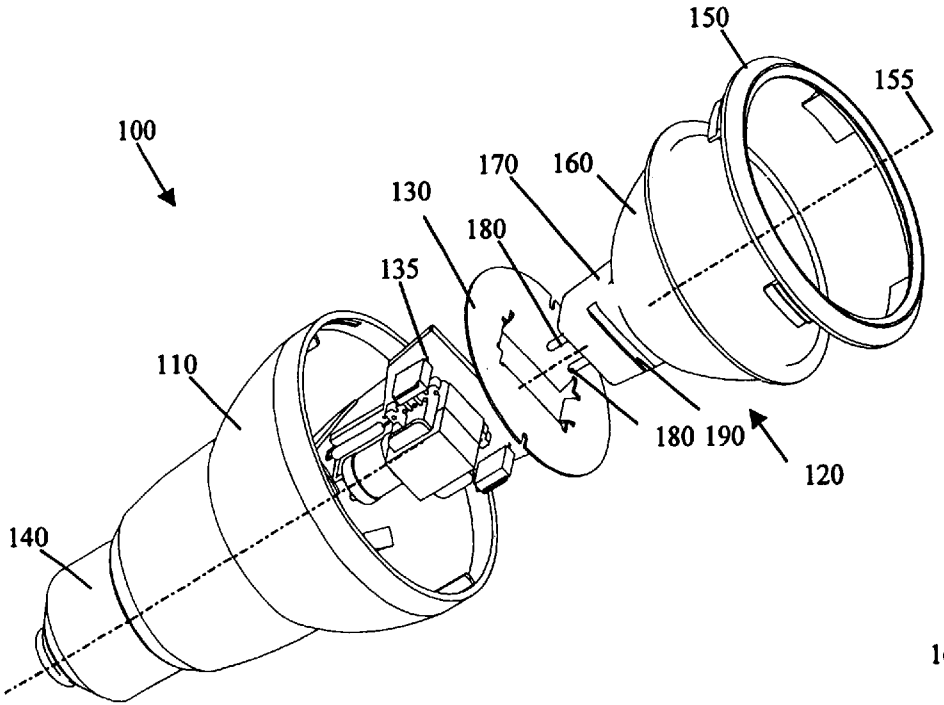
FIG. 1 shows a perspective view of an exemplary lighting system embodying the present invention.

With reference to the Figures, several embodiments of the present invention will now be shown and described. Like reference numerals are used to indicate the same element throughout the specification. FIG. 1 depicts an exploded perspective view of an exemplary lighting system or integral lamp assembly 100 embodying the present invention.

In FIG. 1, the lighting system 100 comprises an outer or lamp housing 110 having an interior space of sufficient size to support a lamp filament and reflector subassembly or lamp 120, a retainer 130, and an electronic power converter circuit 135. The lighting system 100 also includes a lamp base 140 fixed to the outer housing 110. The lighting system 100 may further include a retainer cap 150. The retainer cap 150 further insures that the lamp filament and reflector subassembly 120 will not separate from the electronic power converter circuit 135 contained in the outer housing 110.

Figure 2:
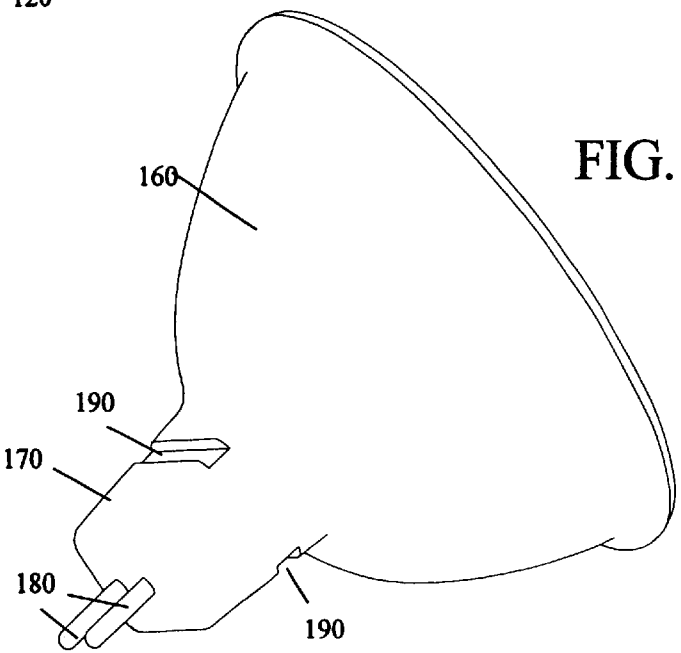
FIG. 2 shows a perspective view of a lamp filament and reflector subassembly used in the lighting system of FIG. 1.

The lamp filament and reflector subassembly 120 is a commercially available lamp, such as a General Electric Company halogen lamp, part number Q20MR16, which is used in prior art light fixtures having external electronic power converters. The lamp filament and reflector subassembly 120 includes a reflector 160 and a cover glass lens (not shown). The cover glass lens encloses a lamp filament within the reflector 160. The reflector 160 is preferably generally parabolic and has an elongated neck 170, generally rectangular in section, through which electrical pin connectors 180 of the lamp filament extend. The reflector neck 170 has at least two channels or snap-grooves 190 located on opposite sides of the outer surface of the neck. FIG. 2 shows a perspective view of the reflector 160.

Figure 3:
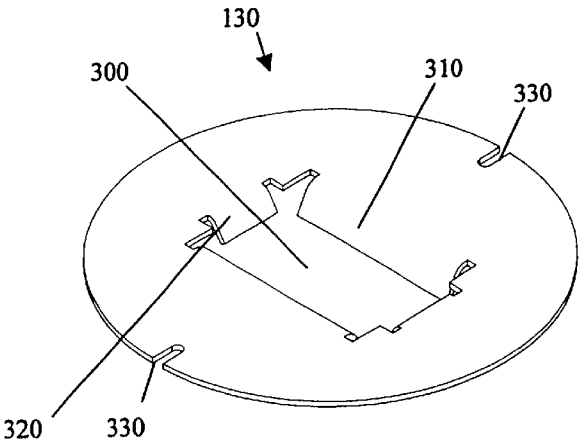
FIG. 3 shows an elevational view of a retainer used in the lighting system of FIG. 1.

The exemplary retainer 130, which is best seen in FIG. 3, includes a peripheral portion, such as a disc, that bounds an opening or through passage 300 of sufficient size for receiving the reflector neck 170. The opening 300 typically has the same shape as the reflector neck 170 (e.g., generally rectangular). The retainer 130 may also include a plurality of flanges 310, 320 (in this example, four), and a plurality of side notches 330 (in this example, two) along the opening 300. The retainer 130 engages and securely attaches to the reflector neck 170. In this example, the flanges 310 interconnect with the reflector neck channels 190. The other flanges 320 rest against the non-channel sides of the reflector neck 170. The flanges 310, 320, which may also function as guides for the retainer 130, spring back automatically as the reflector neck 170 passes through the retainer cavity 300.

The retainer side notches 330 assist in centering and keying the lamp filament and reflector subassembly 120 to the outer housing 110. For example, the outer housing 110 may have protrusions which mate with the retainer side notches 330 for proper placement of the lamp filament and reflector subassembly 120 within the outer housing 110 and prevent the lamp filament and reflector subassembly 120 from rotating within the outer housing 110. The retainer 130 may be secured to the outer housing 110 by snapping, welding, or placing, the retainer 130 on or in between outer housing protrusions located at predetermined locations on an interior surface of the outer housing 110. The housing protrusions are preferably spaced sufficiently apart on the interior surface to adequately support the retainer 130.

In an alternative embodiment, the side notches 330 may further be used to secure the retainer 130 to the outer housing 110. For example, the side notches 330 may receive rivets or other fasteners for securing the retainer 130 to the outer housing 110.

The retainer 130 may perform several functions. For example, the retainer 130 secures the lamp filament and reflector subassembly 120 to the outer housing and prevents the lamp filament and reflector subassembly 120 from separating from the electronic power converter circuit 135. The retainer 130 may also orient or key the lamp filament and reflector subassembly 120 to the electronic power converter circuit 135 so that an electrical connection is made. Further, the retainer 130 may center and position the lamp filament and reflector subassembly 120 within the lighting system 100 so that a light beam from the lighting system 100 is substantially parallel to a main axis 155 of the lamp.

The retainer 130 may also act as a barrier to thermal radiation, thereby lowering the temperature of the electronic power converter circuit 135. Additionally, the retainer 130 may act as a thermal conductor, which channels heat away from the base 140 to the outer housing 110 of the lighting system 100.

Figure 4:
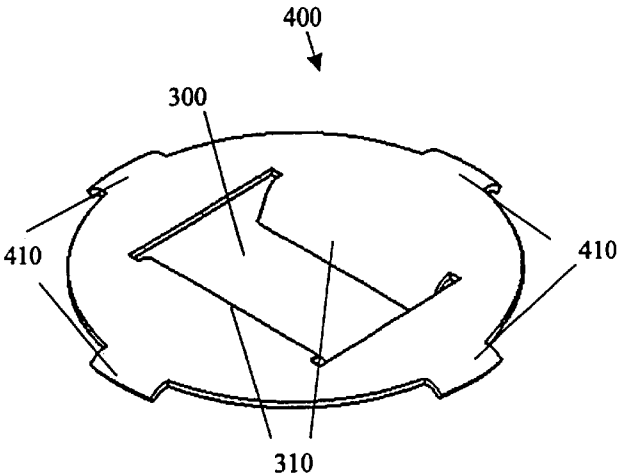
FIG. 4 shows an elevational view a second embodiment of the retainer used in the lighting system of FIG. 1.

FIG. 4 depicts an elevational view of one alternative embodiment of the retainer. The retainer 400 contains the retainer opening 300, a plurality of flanges 310 (in this example, two), and a plurality of tab protrusions 410 (in this example, four). The retainer tab protrusions 410 position and secure the retainer 400 to the outer housing 110 by engaging the inner side of the outer housing 110 at pre-determined locations.

Once secured in place, the retainer 130 or 400 prevents the lamp filament and reflector subassembly 120 from separating from the outer housing 110 or from the integrally connected electronic power converter circuit 135. The retainer 130 or 400 also prevents the reflector from moving upward from or downward into the outer housing 110. The retainer 130 or 400 is preferably formed from metal. However, other materials may also be used. It will also be appreciated that the retainer 130 or 400 may have other shapes. The retainer 130 or 400 also may be secured to the outer housing 110 in various other manners, such as by molding the retainer 130 or 400 into the outer housing 110.

Figure 5:
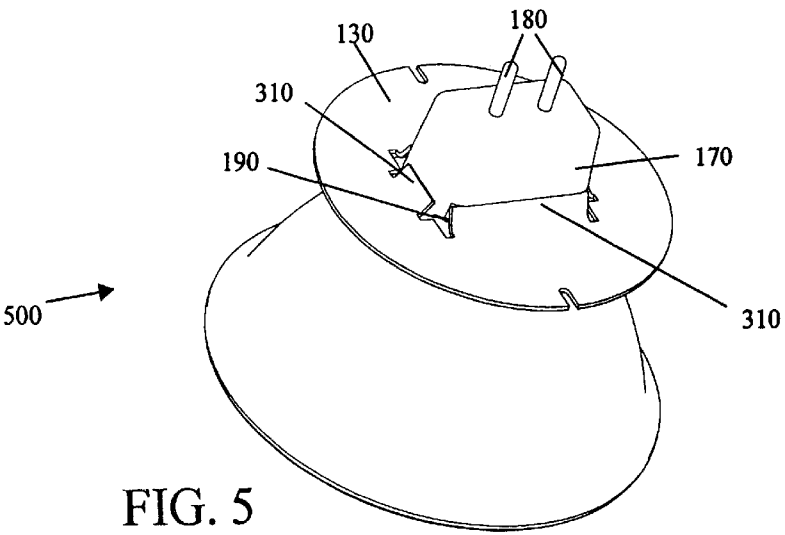
FIG. 5 depicts a reflector coupled to a retainer used in lighting system of FIG. 1.

To mount the lamp filament and reflector subassembly 120 in the outer housing 110, the reflector neck 170 is inserted through the retainer opening 300 until the neck channels 190 engage the reflector flanges 310. This results in a reflector-retainer subassembly 500, as seen in FIG. 5. Preferably, the reflector-retainer subassembly 500 withstands the lamp retention and "screw shell" tests prescribed in an industry standard, such as UL 496, so that the lamp filament and reflector subassembly 120 is secured to the retainer 130 and not easily taken apart.

The reflector-retainer subassembly 500 is electrically connected to the electronic power converter circuit 135. The electrical connection is accomplished in any number of manners known in the art. For example, the electrical pin connectors 180 may be welded or soldered to one end of electrical wires. The other end of the electrical wires are electrically connected, such as by soldering, to a circuit board containing components of the electronic power converter circuit 135.

The electronic power converter circuit 135 and the reflector and retainer subassembly 120 are then inserted into the outer housing 110 until the retainer 130 engages the outer housing 110 at the pre-determined location. An optional retainer cap 150 may then be placed over at least a portion of the reflector 160 and attached to the outer housing 110.

In summary, embodiments of the invention provide a simple and inexpensive device for securing existing lamps in an outer housing which contains an electronic converter. The retainer mechanically secures commercially available lamps in place, removing the need for custom lamp assemblies. The retainer prevents the lamp filament and reflector subassembly from rotating within the outer housing. The retainer also provides a barrier to thermal radiation. Moreover, the retainer provides a conductive path for heat from the lamp to the outer housing, which allows the electronic components of the electronic power converter circuit to operate at a lower temperature.

Furthermore, since numerous modifications and variations will readily occur to those skilled in the art, it is not desired that the present invention be limited to the exact construction and operation illustrated and described herein, and accordingly, all suitable modifications and equivalents which may be resorted to are intended to fall within the scope of the claims.

What is claimed is:

1. A lamp securing device for securing a lamp to a housing, comprising:

a) a retainer including a peripheral portion that bounds an opening of sufficient size for receiving a neck of the lamp; and b) the retainer including a plurality of flanges along the opening which engage the neck of the lamp to securely attach the retainer to the lamp.

2. The lamp securing device of claim 1, wherein the flanges engage channels on an outer surface of the neck.

3. A lighting system, comprising:

a) a housing having an interior space;

b) a base fixed to the housing;

c) a lamp within the housing, the lamp having a neck;

d) an electronic circuit supported within the housing, the electronic circuit connected to the lamp; and e) a flanged retainer securely attached to the lamp, the retainer securing the lamp to the housing.

4. The lighting system of claim 3, wherein the electronic circuit is a power converter.

5. The lighting system of claim 3, wherein the flanges engage channels on an outer surface of the neck.

6. The lighting system of claim 3, wherein the retainer is secured to the housing by tab protrusions extending from sides of the retainer.

7. The lighting system of claim 3, wherein the retainer is secured to the housing by fasteners which extend through side notches of the retainer.

8. The lighting system of claim 3, wherein the retainer orients pins of the lamp to connect the lamp to the electronic circuit.

9. The lighting system of claim 3, wherein the retainer positions the lamp within the lighting system.

10. The lighting system of claim 3, wherein the retainer acts as a barrier to thermal radiation between the lamp and the electronic circuit.

11. The lighting system of claim 3, wherein the retainer acts as a thermal conductor.

12. The lighting system of claim 3, further comprising a retainer cap which attaches to the housing.

13. The lighting system of claim 3 wherein the flanged retainer further includes:

a) a peripheral portion that bounds an opening of sufficient size for receiving the neck of the lamp; and b) the flanged retainer including a plurality of flanges along the opening which engage the neck of the lamp.

14. The lighting system of claim 13, wherein the flanges engage channels on an outer surface of the neck.

15. A method for assembling a lighting system, comprising:

a) inserting a neck of the lamp through an opening in a retainer until flanges bordering the opening engage the neck to securely attach the retainer to the lamp; and b) electronically connecting an electronic circuit to the lamp; and c) securing the retainer in a housing.

16. The method of claim 15, wherein the flanges engage channels on an outer surface of the neck.

17. The method of claim 15, further comprising attaching a retainer cap to the housing, the retainer cap covering at least a portion of the reflector.

* * * * *